US008261475B1

(12) United States Patent
Thomsen

(10) Patent No.: US 8,261,475 B1
(45) Date of Patent: Sep. 11, 2012

(54) FIGURATIVE PRINT ON A PLANE PRINT CARRIER AND USE OF SUCH FIGURATIVE PRINT

(76) Inventor: Erik Brogaard Thomsen, Vejle (DK)

( * ) Notice: Subject to any disclaimer, the term of this patent is extended or adjusted under 35 U.S.C. 154(b) by 1076 days.

(21) Appl. No.: 09/381,771

(22) PCT Filed: Mar. 25, 1998

(86) PCT No.: PCT/DK98/00119

§ 371 (c)(1),
(2), (4) Date: Oct. 26, 1999

(87) PCT Pub. No.: WO98/43231

PCT Pub. Date: Oct. 1, 1998

(30) Foreign Application Priority Data

Mar. 25, 1997 (DK) ..... 9700140 U

(51) Int. Cl.
*G09F 7/00* (2006.01)

(52) U.S. Cl. ..... 40/596

(58) Field of Classification Search ..... 40/427, 40/615, 596, 624; 283/86; 345/144, 471, 345/467, 469
See application file for complete search history.

(56) References Cited

U.S. PATENT DOCUMENTS

| | | | | |
|---|---|---|---|---|
| 1,592,034 | A * | 7/1926 | Macy | |
| 3,249,994 | A * | 5/1966 | Hill | 29/460 |
| 3,675,355 | A * | 7/1972 | Shanok et al. | 40/596 |
| 4,450,640 | A * | 5/1984 | Shapiro et al. | 40/596 |
| 4,667,236 | A | 5/1987 | Dresdner | 358/160 |
| 4,956,706 | A | 9/1990 | Ohba | 358/93 |
| 5,421,583 | A * | 6/1995 | Gluck | 40/160 |
| 5,941,002 | A * | 8/1999 | Rusin | 40/606 |

FOREIGN PATENT DOCUMENTS

| | | | |
|---|---|---|---|
| DE | 4214819 | | 10/1992 |
| FR | 2608788 | | 12/1986 |
| GB | 2315794 | A * | 2/1998 |
| WO | 9304559 | | 3/1993 |

OTHER PUBLICATIONS

Fontworks, Sanity copywritten 1997 Dan Redding & Blue Knot Software.*

Anamorphoses chasse a travers les collections due musee, Musee des Arts Decoratifs Paris, 27 fevrier-9 mai 1976.

Gobes Handbuch der Mathematik; 950 Textabbildungen, davon uber 700 mehrfarbig, und 72 Bildtafeln, Buch Und Zeit Verlagsges, M.B. H. Koln 1967.

* cited by examiner

*Primary Examiner* — Joanne Silbermann
(74) *Attorney, Agent, or Firm* — McCarter & English, LLP

(57) ABSTRACT

The invention relates to a figurative print for a plane print carrier. In a preferred embodiment, the figurative print comprises a primary, a secondary, and a tertiary figurative element. Each of the three elements shows an angular displacement of between 0° and 90° in relation to a perpendicular view of the figurative print on the plane print carrier so that the figurative print appears with a special effect, when the print is viewed from an oblique position relative to a perpendicular viewing.

10 Claims, 3 Drawing Sheets

FIGURATIVE PRINT ON A PLANE PRINT CARRIER AND USE OF SUCH FIGURATIVE PRINT

BACKGROUND OF THE INVENTION

The present invention relates to an advertisement print being printed on a plane print carrier, and which print is plane and lies in the same plane as the print carrier and comprises a primary figurative element depicting an advertisement in a first dimension and a second dimension, which primary figurative element when seen in a direction perpendicular to the plane of the print carrier constitutes an angle $\alpha+90°$ between the first dimension and the second dimension, and which primary figurative element when seen in a given oblique direction between a viewer and the print shows the first dimension and the second dimension as forming a plane of advertisement, which plane of advertisement is directed obliquely outwards of, preferably perpendicular to, the plane of the print carrier.

It is known to apply a figurative print, like an advertising print, on a plane print carrier, like a football field. The print is depicted in two dimensions, like the print will normally appear on a plane print carrier. Thus, the print is intended to be viewed perpendicularly to the plane print carrier such as a lawn. Especially in connection with football fields, this is an advantage so that many of the spectators at the football match may see the advertising print. However, it is a drawback that a spectator like a television viewer of a television transmitted football match does not get the full benefit from the advertising value of the advertising print, as a given TV camera is not necessarily placed and views the advertising print in such a way that the advertising print appears in the best possible way for a television viewer.

WO 93/04559 describes an image depicted on as example a playing field for a sporting event. The image is depicted in a so-called inverse perspective form resulting in that when a viewer from a selected spot outside the playing field views the inverse perspective formed image, then the image appears as a plane image having a line of sight corresponding to the line of sight of the viewer. In other words the line of sight of the inverse perspective formed image appears as a line of sight perpendicular to the inverse perspective formed image and this line perpendicular to the image corresponds to the line of sight of a viewer. However, this kind of depiction involves the problem that the image does not appear to be part of the surroundings of the playing field and thus the image is confusing to view when the viewer at the same time views the sporting event at the playing field. The viewer will not be able to view the sporting event without being confused by the inversed perspective formed image because this image has a line of sight corresponding to the line of sight of the viewer but the sporting event and the surroundings of the playing field is, of course, not only arranged for the purpose of the selected viewer in question but of course arranged for the purpose of all the other spectators watching the sporting event at the playing field. The line of sight of the other spectators is different than the one and only selected viewer for which the inverse perspective formed image is made.

DE-42 14 819 describes a depiction at the inside lateral walls of a tunnel. The purpose of such a depiction is to limit the effect of the so-called "tunnel sight" which may appear in long tunnels and can have dangerous effect to traffic when the drivers leave the tunnel and suddenly enter open spaces. This prior art proposes to provide the lateral walls with images reducing the effect of the tunnel sight by having different trapezoidal images depicted at the walls. However, because of the purpose of these images the effect obtained is a three-dimensional effect of niches. However, such images depicted at a plane printing carrier is not suited for other purposes such as advertising on a plane field for a sporting event.

It is the purpose of the present invention to provide a figurative print which is applied to a plane print carrier so that the print appears in the best possible way for a chosen viewer but by maintaining the appearance of the print constituting a part of surroundings of other viewers.

This purpose is achieved with a figurative print which is peculiar in that the advertisement print comprises a secondary figurative element depicting the advertisement in a third dimension, that the secondary figurative element when seen in a direction perpendicular to the plane print carrier constitutes an angle $\alpha+\beta$ between the first dimension and the third dimension and an angle $\beta+90°$ between the second dimension and the third dimension and which secondary figurative element when seen in the given oblique direction between the viewer and the print shows the third dimension as directed perpendicular to the plane of advertisement being formed by the first and the second dimension and that the angles $\alpha$, $\beta$ are different from 0°.

The oblique viewing of the print may correspond to an angle at which a TV camera is placed as compared to a perpendicular viewing of the print. The oblique viewing of the print may also correspond to an angle that e.g. car drivers on a road pass as seen in relation to a viewing of the print being parallel with the print carrier and perpendicular to a base line. The oblique viewing of the print may be any angle so that the print appears in the best possible way before a viewer in a given position relative to the print, i.e. corresponding to a perpendicular view facing the viewer in question.

By imparting a secondary figurative element to the print it is possible on a plane print carrier to achieve a three-dimensional effect of the print for the viewer in question. As the primary figurative element, the secondary figurative element is subjected to an angular displacement which on a plane print carrier results in a three-dimensional effect that is the best possible for the viewer in question, i.e. a three-dimensional effect corresponding to a perpendicular viewing of the print.

A secondary figurative element may be a shadow effect, a relief effect or another three-dimensional effect of the primary figurative element.

In an alternative embodiment of the figurative print according to the invention, the print is peculiar in that the print comprises a tertiary figurative element depicting surroundings of the primary and secondary figurative element, that the tertiary figurative element as seen in a direction perpendicular to the plane print carrier is applied with an angular displacement $\delta$ of the figurative element, and that the angular displacement $\delta$ is equal to an angle between a view of the print being parallel with the print carrier and being perpendicular to the base line and an oblique view of the print relative to the said view of the print.

The tertiary figurative element may comprise a foreground, a background or a frame.

The print according to the invention may be applied directly to the plane print carrier by spraying ink on the plane print carrier or in another way. The print according to the invention may also be applied to the plane print carrier by making the print on a carrying medium like a paper web, and that the carrying medium subsequently is applied to the plane print carrier, e.g. by pasting.

DESCRIPTION OF THE DRAWING

The invention will be described in the following with reference to the attached drawing, in which

FIG. 1 shows how a print according to the invention will be viewed by a viewer that is positioned in the best possible way for viewing the print. The print shows the mark Kvickly, which in Denmark is a tradename for conveniences sold by Fællesforeningen for Danmarks Brugsforeninger, the Danish Co-operative Wholesale Society. The print is illustrated in a situation, where the print is applied to a football field behind a football goal.

The print consists of a first figurative element which is toned grey and which constitutes the word part, Kvickly, a secondary figurative element which is black and which gives a depth of the word part, Kvickly, and a tertiary figurative element which is white and which constitutes a background for the primary and the secondary figurative element.

The print is applied with angular displacements relative to a perpendicular view of the primary and the secondary figurative element so that the primary figurative element and the secondary figurative element in combination cause the mark Kvickly to appear as standing up perpendicularly on the football field and with a depth perpendicular to a back line behind the football goal. The primary figurative element forms what may be called a plane of advertisement and the secondary figurative element forms a shadow or a relief of the primary figurative element. The print is applied with angular displacements relative to a perpendicular view of the tertiary figurative element so that the background appears plane with the football field and rectangularly with sides that are perpendicular and parallel, respectively, with the back line behind the football goal.

Figure 1:
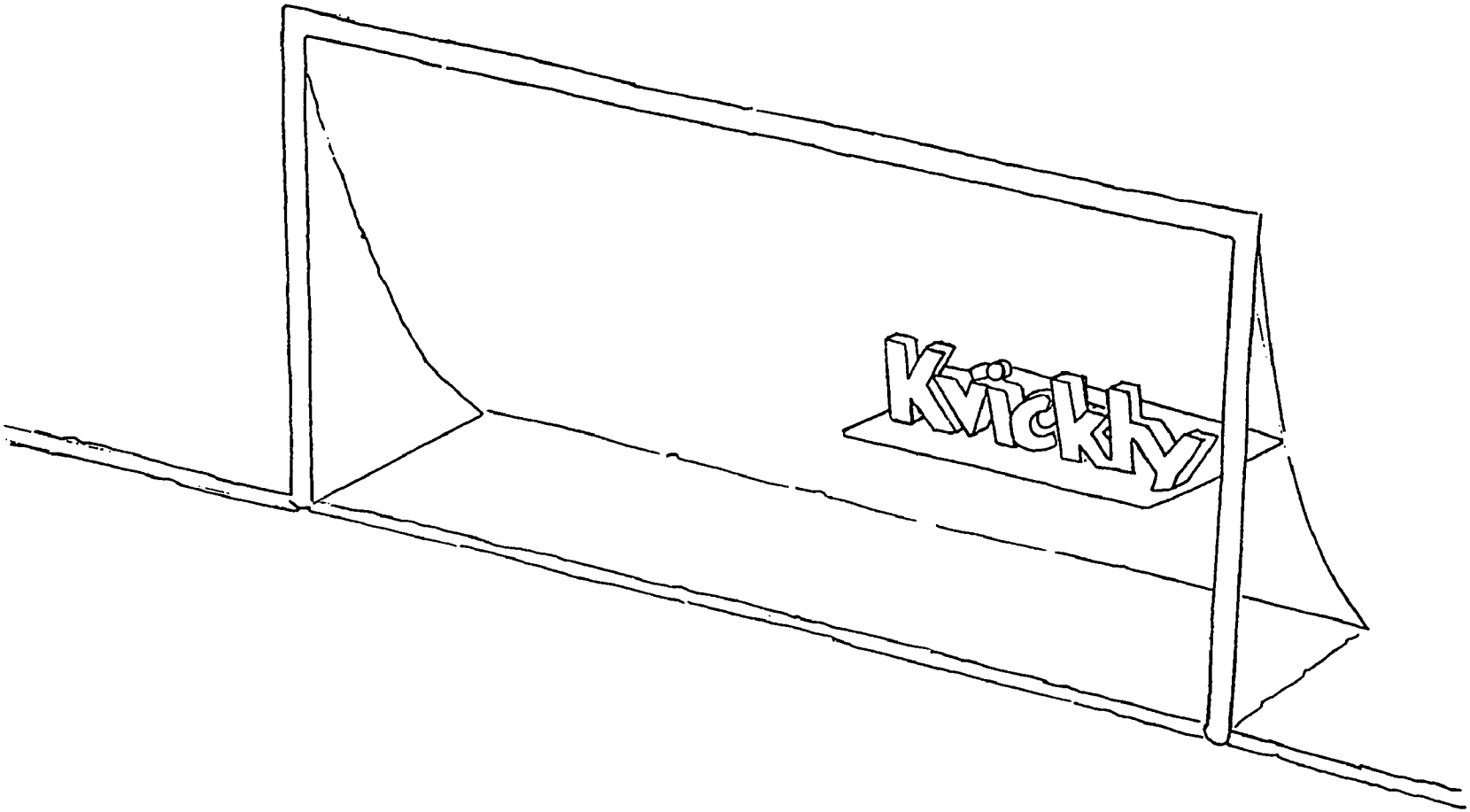
FIG. 1 is a perspective view of a best possible viewing of the print according to the invention.
Figure 2:
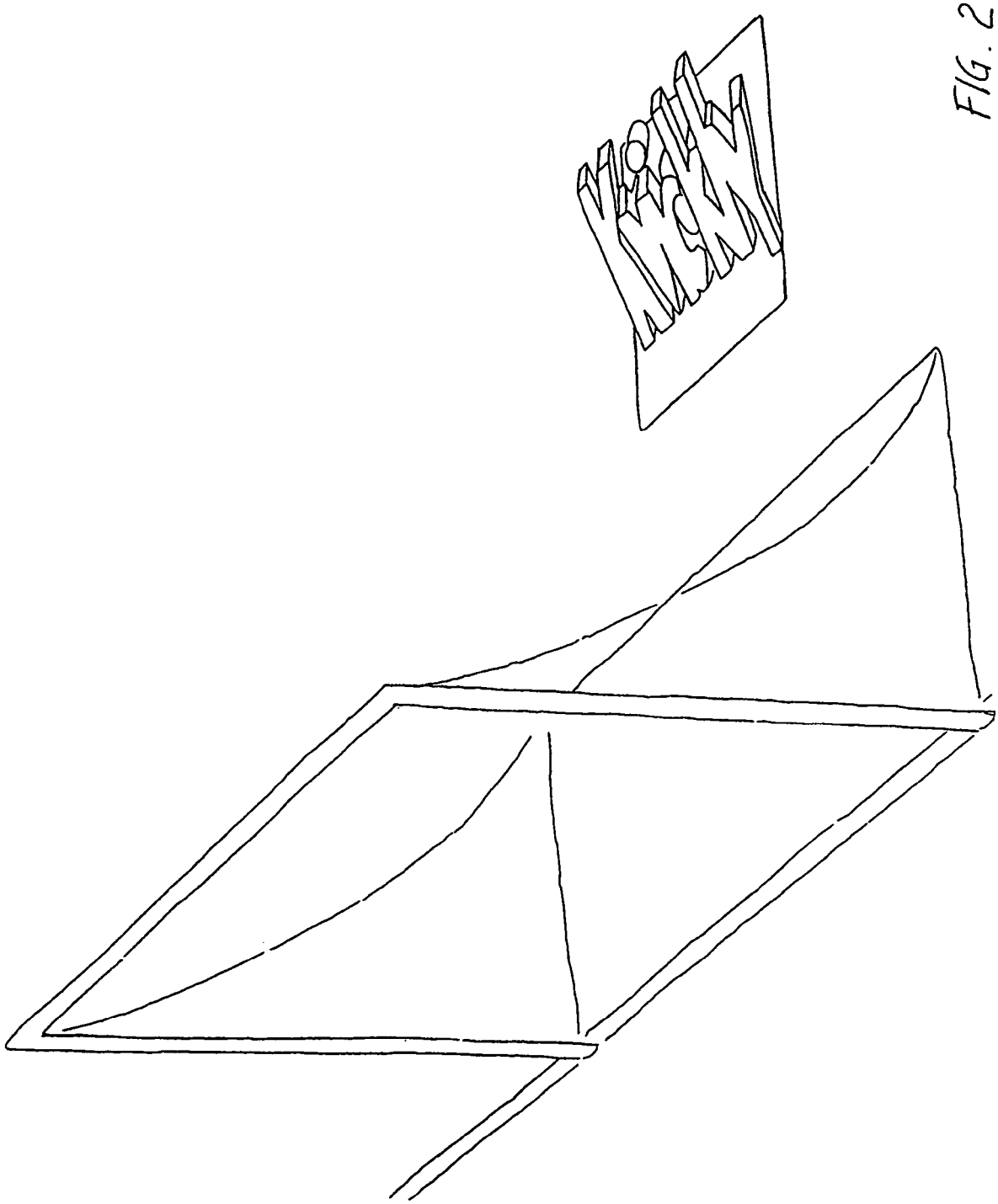
FIG. 2 is a perspective view of a very inferior viewing of the print according to the invention.

FIG. 2 shows how a print according to the invention will be viewed by a viewer who is positioned very inferiorly in relation to a viewing of the print. It appears that the print does not achieve the same effect as if viewed from a position corresponding to FIG. 1. Viewing as in FIG. 2 is actually worse than viewing of a print that is plane with the football field, and which is depicted as viewed perpendicularly and seen perpendicularly on the football field. The print according to the invention is, however, intended to be viewed by a viewer in a given position in relation to the print, which position is different from the position in FIG. 2 and equal to the position in FIG. 1.

The print according to the invention is therefore intended to make allowance for a viewer viewing the print from a given position relative to the print which is an oblique viewing of the print compared to the perpendicular viewing of the print. The print may thus be indented to make allowance for a television viewer of a football match viewing the print from a position of a TV camera or to make allowance for a car driver in front of a company domicile viewing the print from a position on a road.

Figure 3:
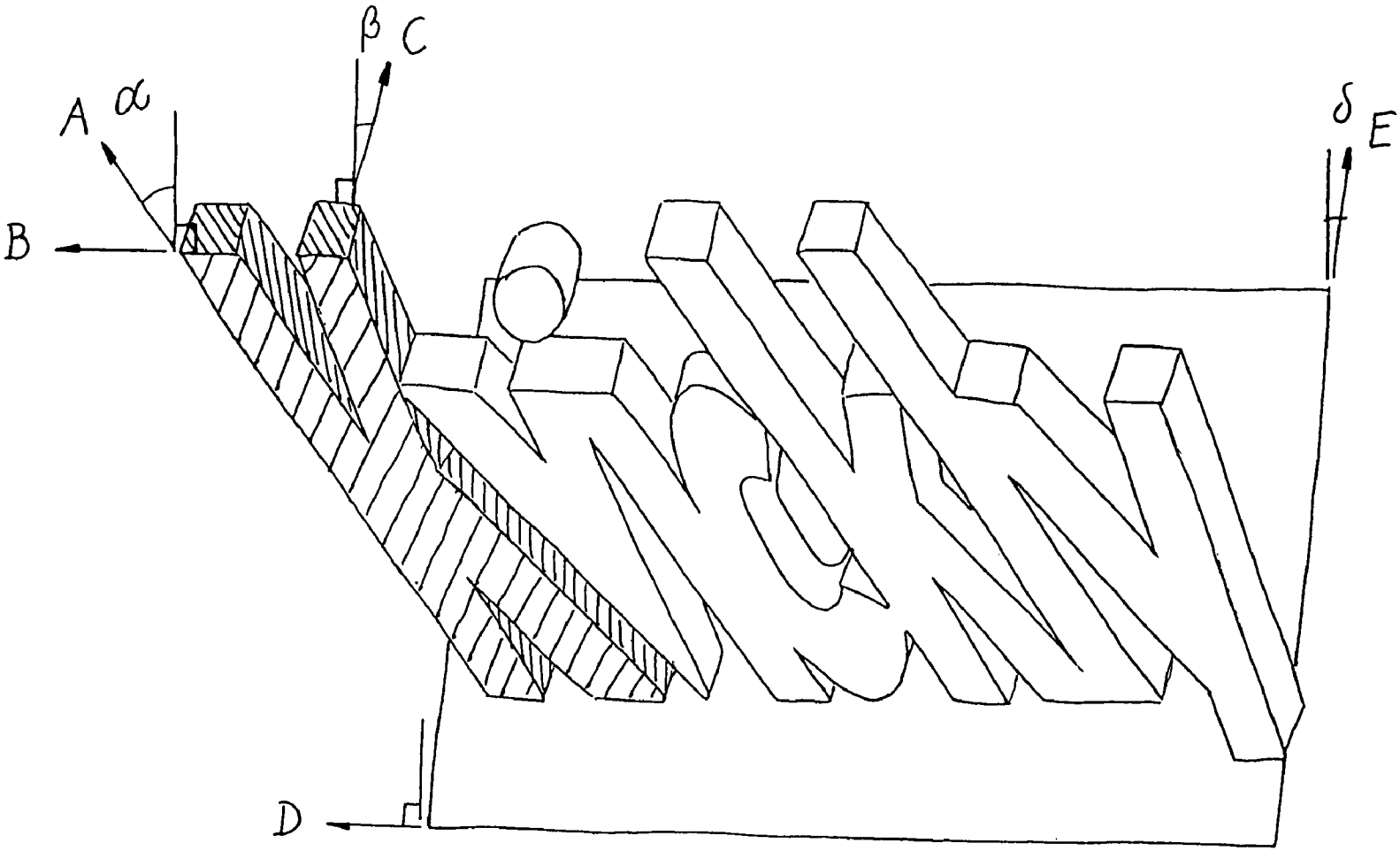
FIG. 3 is a plane view of a print according to the invention.

FIG. 3 shows a plane view of the print as it appears when the print is viewed perpendicularly and seen perpendicularly on the plane of the paper. The print comprises a primary figurative element, which for the purpose of illustration in the first big K of Kvickly is roughly hatched, i.e. less densely hatched, a secondary figurative element, which for the purpose of illustration in the first K of Kvickly is finely hatched, i.e. more densely hatched, and a tertiary figurative element forming a parallelogram that in the shown view is not hatched at all.

The first figurative element gives the advertisement print a first dimension A and a second dimension B. An angle between the first dimension A and the second dimension B is constituted by adding an angle $\alpha$, which in the shown view is about 35° with a right angle being 90°.

The secondary figurative element gives the advertisement print a third dimension C. An angle between the first dimension of the primary figurative element and the third dimension of the secondary figurative element is constituted by adding to the angle $\alpha$ and angle $\beta$, which in the shown view is about 20°. An angle between the second dimension of the primary figurative element and the third dimension of the secondary figurative element is constituted by adding to a right angle being 90° the angle $\beta$.

The tertiary figurative element forms surroundings of the primary and the secondary figurative element. An angle between the first dimension A of the primary figurative element and the sideways dimension D of the tertiary figurative element is constituted by subtracting from a right angle being 90° the angle $\alpha$. The second dimension B of the primary figurative element and the sideways dimension D of the tertiary figurative element are parallel. An angle between the third dimension C of the secondary figurative element and a backwards/forwards dimension E of the tertiary figurative element is constituted by subtracting from the angle $\beta$ and angle $\delta$ which in the shown view is about 5°.

The angles $\alpha$, $\beta$, and $\delta$ may vary arbitrarily between 0° and 90°. It depends completely on the position of the viewer in relation to the position of the print on the plane print carrier. The plane print carrier to which the figurative print is applied may be a ground surface such as a lawn, a road way like a parking lot, a house front like a company domicile, a transport means like a bus, or even further applications.

It will be possible to use print according to the invention consisting of a number of the primary, secondary and tertiary figurative elements.

The invention claimed is:

1. A method of:

providing an image to be viewed, whereby said image has first, second and third orthogonal directions;

reconfiguring said image to a planar image whereby said first orthogonal direction and said second orthogonal direction form an angle of 90 degrees minus a first predetermined non-zero angle and whereby said second orthogonal direction and said third orthogonal direction form an angle of 90 degrees plus a second predetermined non-zero angle;

placing said reconfigured planar image at a given angle with respect to a viewer whereby said image appears to the viewer to protrude from said reconfigured planar image and have said first, second and third orthogonal directions, wherein the first and second orthogonal directions form a plane different from the plane of said planar image; and wherein said image comprises a primary figurative element and a secondary figurative element, wherein said secondary figurative element depicts a third dimension of said image.

2. The method of claim 1 wherein said secondary figurative element is chosen from the group consisting of a shadow and a relief.

3. The method of claim 1 wherein said image further comprises a tertiary element which provides an element chosen from the group consisting of a foreground, background and frame.

4. The method of claim 3 wherein said first and second predetermined angles are less than ninety degrees.

5. The method of claim 1, wherein the planar image is made of a curable, liquid printing ink, that the ink is applied to a planar print carrier in a liquid state, and that the ink is cured on the planar print carrier.

6. The method of claim 1, wherein the planar image is made by printing on a carrying medium and that the carrying medium is laid on a planar print carrier.

7. The method of claim 6, wherein the planar print carrier is a ground surface.

8. The method of claim 6, wherein the planar print carrier is a vertical surface.

9. The method of claim 1 wherein said reconfigured planar image is horizontal and placing said reconfigured planar image at a given angle with respect to a viewer whereby said image appears to the viewer to protrude vertically from said reconfigured planar image.

10. The method of claim 1 wherein placing said reconfigured planar image at a given angle with respect to a viewer whereby said image appears to the viewer to protrude perpendicularly from said reconfigured planar image.

* * * * *